US006213645B1

(12) United States Patent
Beer

(10) Patent No.: US 6,213,645 B1
(45) Date of Patent: Apr. 10, 2001

(54) FLEXIBLE PACKAGE WITH SEALED EDGES AND EASY TO OPEN MOUTH

(75) Inventor: Jeffrey Scott Beer, Perkiomenville, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

(21) Appl. No.: 09/525,629

(22) Filed: Mar. 14, 2000

(51) Int. Cl.[7] ..... B65D 33/00

(52) U.S. Cl. ..... 383/211; 383/61; 383/63; 383/103; 383/107; 383/120; 383/203

(58) Field of Search ..... 383/210, 211, 383/203, 61, 120, 63, 107, 119, 103

(56) References Cited

U.S. PATENT DOCUMENTS

| | | | | |
|---|---|---|---|---|
| D. 350,696 | | 9/1994 | Naslund . | |
| 819,056 | | 5/1906 | Garber . | |
| 2,093,974 | | 9/1937 | Farmer . | |
| 2,093,979 | | 9/1937 | Farmer . | |
| 2,188,039 | | 1/1940 | Farmer . | |
| 2,260,192 | | 10/1941 | Orr . | |
| 2,789,728 | | 4/1957 | Britton . | |
| 2,815,150 | | 12/1957 | Herzig . | |
| 3,085,738 | | 4/1963 | Bok . | |
| 3,353,741 | | 11/1967 | Kamins et al. . | |
| 3,363,827 | | 1/1968 | Renner et al. . | |
| 3,595,467 | | 7/1971 | Goglio . | |
| 3,642,189 | | 2/1972 | Widenback . | |
| 3,688,973 | | 9/1972 | Linllkvist . | |
| 3,815,810 | | 6/1974 | Wellman . | |
| 3,858,789 | | 1/1975 | Verbeke . | |
| 3,938,659 | | 2/1976 | Wardwell . | |
| 3,982,574 | | 9/1976 | Bianchi et al. . | |
| 4,142,667 | | 3/1979 | Runo . | |
| 4,176,746 | * | 12/1979 | Kooi | 383/120 X |
| 4,260,061 | | 4/1981 | Jacobs . | |
| 4,310,118 | | 1/1982 | Kisida et al. . | |
| 4,483,445 | | 11/1984 | Lepisto et al. . | |
| 4,488,647 | * | 12/1984 | Davis | 383/210 X |
| 4,518,087 | | 5/1985 | Goglio . | |
| 4,576,285 | | 3/1986 | Goglio . | |
| 4,603,537 | * | 8/1986 | Pace | 383/210 X |
| 4,705,174 | | 11/1987 | Goglio . | |
| 4,753,489 | | 6/1988 | Mochizuki . | |
| 4,787,755 | | 11/1988 | Branson . | |
| 4,807,300 | | 2/1989 | Ausnit et al. . | |
| 4,871,264 | | 10/1989 | Robbins, III et al. . | |
| 4,913,561 | | 4/1990 | Beer . | |
| 4,953,708 | | 9/1990 | Beer et al. . | |
| 4,988,216 | | 1/1991 | Lyman . | |
| 4,997,104 | | 3/1991 | Pohl . | |
| 5,037,138 | | 8/1991 | McClintock et al. . | |
| 5,059,036 | | 10/1991 | Richison et al. . | |
| 5,118,203 | * | 6/1992 | Andronico | 383/61 |
| 5,147,272 | | 9/1992 | Richison et al. . | |
| 5,352,466 | * | 10/1994 | Delonis | 383/210 X |
| 5,392,589 | * | 2/1995 | Buchanan | 383/211 X |
| 5,692,837 | | 12/1997 | Beer . | |
| 5,738,444 | | 4/1998 | Lantz et al. . | |
| 5,842,790 | * | 12/1998 | Imer | 383/107 X |
| 5,944,425 | | 8/1999 | Forman . | |
| 6,033,114 | * | 3/2000 | Grimm et al. | 383/120 X |

* cited by examiner

*Primary Examiner*—Jes F. Pascua
(74) *Attorney, Agent, or Firm*—Caesar, Rivise, Bernstein, Cohen & Pokotilow, Ltd.

(57) ABSTRACT

A package fabricated from a flexible sheet material capable of being sealed for closing off the interior of the package from ambient atmosphere is disclosed. The package has two or more side walls and a like number of side seams. The package has an open upper end portion terminating in a free edge. The inner surface of the side walls has a releasably securable adhesive adjacent the upper end portion in a pattern wherein the adhesive does not extend into the area of the side seams, thus increasing the structural integrity of the package.

18 Claims, 4 Drawing Sheets

FLEXIBLE PACKAGE WITH SEALED EDGES AND EASY TO OPEN MOUTH

BACKGROUND OF THE INVENTION

This invention relates generally to packaging and to flexible packaging. More particularly, this invention relates to packages made from flexible packaging material having an opening sealed by a peelable seal that may be hand opened.

Flexible containers or packages formed of sheet materials have been used for many years and have wide acceptance for holding various air-perishable products, e.g., coffee and other foodstuffs. Prior art flexible, air-tight packages are commonly constructed of some plastic film, metal foil, or combinations thereof, in one or more plies and sealed along one or more seams. Such packages are usually vacuumized after filling but prior to sealing so that the contents of the package are not exposed to the degradation effects of air. Accordingly, products held in such packages can have a shelf life comparable to rigid packages, such as jars with screw-on lids or metal cans.

The advantages of flexible packages over rigid packages are many. For example, flexible packages can be manufactured at substantially lower cost and can be stored flat, thereby resulting in enormous space savings over rigid packages. Moreover, flexible packages are substantially lighter in weight, thereby resulting in reduced transportation costs for unfilled packages. Further still, flexible packages are generally of an overall parallelepiped shape when filled so that such packages take up considerably less shelf or storage space. Needless to say, this feature is of considerable importance insofar as transportation, storage, and display are concerned.

It is common practice to construct the package or bag by heat sealing laminated material to form the package. The package is then filled and its opening typically heat sealed closed to produce the final product for shipment. Packages of the above description may be used in vacuum packing, a familiar technique in which the contents are exposed to a reduced atmosphere during the sealing operation to draw off air or to eliminate gasses which otherwise might evolve or diffuse out of products over time. The present invention may be used, to equal advantage, with vacuum, non-vacuum, or gas-flushed packages.

The seals for packages of the above-described type must of course be strong enough to withstand routine handling and foreseeable mishandling, and to avoid spillage due to failure of the closure. Also, the closure must be strong enough and permanent enough to resist tampering. In typical prior art packages, the seals are often as strong as the other seams of the package. Opening may require the use of knives, scissors or other cutting instruments. As an alternative, schemes have been proposed for the use of frangible elements, tear strips or drawstrings, to facilitate opening. Each of these in some measure complicates the production process, and results in partial or complete destruction of the package upon opening. This latter attribute is itself undesirable, for in the marketing of certain products, it is common to open the package, process the contents (as, for example, in the grinding of coffee beans), and return the processed contents to the package.

While prior art air-tight, flexible packages exhibit the aforementioned advantages over rigid packages, there are still some undesirable characteristics, particularly when it is desired to be able to open and reclose the package after its initial opening. In this regard, as indicated above, the seams of prior art flexible packages are usually permanent in the interest of air tightness and structural integrity and are commonly formed by conventional heat sealing or welding techniques. Thus, the prior art flexible package is typically opened by cutting or tearing one or more of its seams.

Additionally, in the prior art, there is a plastic bag with a peelable portion to form a spout disclosed in U.S. Pat. No. 4,953,708 to Beer. There are many other examples of packages with peelable seal openings, both patented and commercially available. Easy access to a granular product packaged in a flexible material can be provided as described in U.S. Pat. No. 4,518,087 to Goglio.

Another flexible package is disclosed in U.S. Pat. No. 4,488,647 to Davis. Here, the peal seal is not provided in a pattern, but is continuous around the upper end portion of the package such that the adhesive extends into the heat sealed seams, thereby reducing the structural integrity of the package.

Generally, the prior art discloses methods of gaining entry to a package. But, there is no concern that the opening would extend into a sealed corner.

The present invention provides a flexible package which features an easy opening peel seal which can be manufactured in a variety of strengths, and which, unlike known previously existing peel seals is sufficiently strong to meet all of the usual requirements, including the ability to reliably retain vacuum. Another aspect of the novel peel seal of the present package is extreme simplicity of manufacture, in which the making of the seal lends itself to continuous processes of the kinds used to make and fill packages.

Importantly, the area of the peel seal of the present invention does not interfere with the other permanent seams of the package. The process of applying a coating to predetermined area of a laminate web is generally referred to in the flexible packaging industry as "pattern coating". The peel seal is placed on the laminated material by the "pattern coating" wherein the peal seal adhesive is placed away from the heat sealed seams and placed in a pattern only on that portion of the laminate that is actually pealed opened. Therefore, the structural integrity of the main seams is maintained.

OBJECTS OF THE INVENTION

Accordingly, it is a general object of the present invention to provide flexible packaging and a method for producing the same which overcomes the disadvantages of the prior art.

It is a further object of the present invention to provide flexible packaging having an air tight sealed upper end which can readily be pulled open without resulting in the destruction or tearing of any portion of the package, particularly the seams, thereby enabling the package to be reclosed.

It is still a further object of the present invention to provide a flexible package having an open upper end which is sealed by a peelable interface between abutting wall portions of the package and which interface can be readily peeled open without destroying any portion of the package.

It is yet another object of the present invention to provide a flexible package having an open upper end which is sealed by a peelable interface between abutting wall portions of the package wherein the peel seal adhesive does not extend into the area of the permanently sealed corners of the package such that the corners remain permanently sealed to give the package a desired squared off appearance and structurally secure seams.

It is still another object of the present invention to provide a method for producing a flexible package having an air-tight sealed mouth which can readily be peeled open without resulting in the destruction of any portion of the package, particularly, the seams.

It is a further object of this invention to provide a simple and economically viable method for producing a flexible package which is sealed by a peelable interface between abutting wall portions of the package and which interface can be readily opened without destroying any portion of the package, particularly the seams.

SUMMARY OF THE INVENTION

These and other objects of this invention are achieved by providing a package fabricated from a flexible sheet material capable of being sealed for closing off the interior of the package from ambient atmosphere. The package has two or more side walls and a like number of side seams. The package has an open upper end portion terminating in a free edge. The inner surface of the side walls has a releasably securable adhesive adjacent the upper end portion in a pattern wherein the adhesive does not extend into the side seams, thus increasing the structural integrity of the package. A method of producing the package is also provided.

The flexible package with sealed edges and easy to open mouth is designed to hold a free flowing product such as coffee (beans or ground), powdered drink mix, ready to eat breakfast cereal, lawn/garden chemicals, and the like. The package utilizes sealed vertical edges to provide a pleasing visual appearance and to provide support for the package to prevent sag. The mouth of the package is closed with a peel seal enabling the package to be opened by simple hand manipulation.

By applying the peal seal material only to the area of the package requiring opening, and specifically stopping the peel seal material prior to extending into the sealed corners, those corners remain permanently sealed to give the package the desired squared off appearance. Furthermore, if the package is made from a single sheet of laminated material, one of the four corner seals joins the edges of the sheet. If this seal were peelable, the bag formed from the sheet would separate at this seam, thus spilling the contents of the package.

DESCRIPTION OF THE DRAWINGS

Other objects and many attendant features of this invention will become readily appreciated as the same becomes better understood by reference to the following detailed description when considered in connection with the accompanying drawings, wherein.

DETAILED DESCRIPTION OF THE PREFERRED EMBODIMENT

Figure 1:
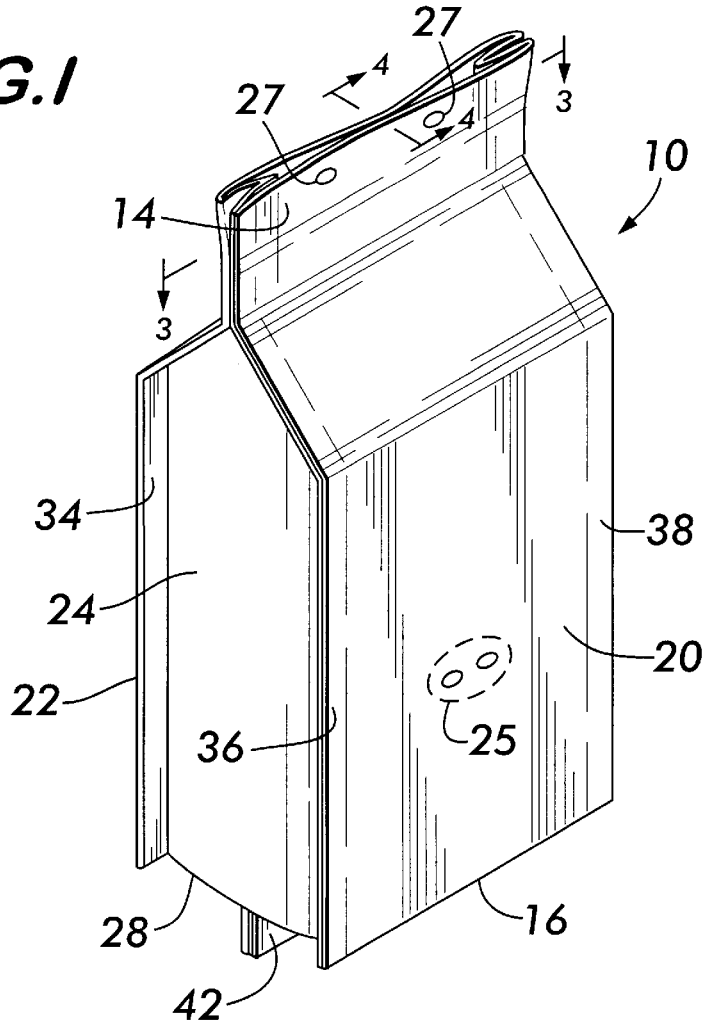
FIG. 1 is a perspective view of the package of this invention, shown in a sealed condition.

Referring now to the various figures of the drawing where like reference numbers refer to like parts, there is shown in FIGS. 1 through 4 a flexible package with sealed edges and easy to open mouth 10 in accordance with one preferred embodiment of the present invention. The package 10 is fabricated from a long strip of any suitable flexible sheet material 12 (see FIG. 6), which preferably is formed primarily from a flat sheet of a plastic. However, more than one sheet may be used. The details of construction of the package 10 and its method of formation will be described later. Suffice it for now to state that the package 10 of the preferred embodiment is of the gusseted type having an upper end portion 14 and a lower end 16 portion. The package 10 is arranged to be filled with product or material 18 (see FIG. 6), e.g. coffee, and then the package 10 is sealed to enclose the contents of the package therein.

As can be seen clearly in FIG. 1, the package 10 basically comprises four side walls or panels, including a front side wall 20, a rear side wall 22, a left side wall 24, and a right side wall 26. A bottom section 28 and a top section 30 are also provided. The top section 30 includes a folded and sealed closure 32 which will be described in further detail below.

A one-way venting valve (not shown) may optionally be mounted in one of the panels, e.g. the front side wall 20 of the package 10. The valve enables gases which may be produced by the material(s) 18 contained within the sealed package 10 to vent to the ambient air without any air gaining ingress to the package's interior.

As can be seen in FIGS. 1 through 4, the front side wall 20, rear side wall 22, and the left and right side walls 24, 26 of the package 10 are all integral portions of a single sheet or web of flexible material 12. See also FIG. 5. As can be seen most clearly in FIGS. 1 and 2, the permanent side seams 34, 36, 38, 40 are formed by the folded or marginal edges of the sheet material 12 which are brought into engagement with each other. Those edges 34, 36, 38, 40 are permanently secured to one another via any conventional sealing technique known in the art, such as heat sealing or welding. The lower end portion 16 of the package 10 may also be sealed closed, for example, along permanent seal line 42.

The left side wall 24 and the right side wall 26 are also preferably of identical construction. As can clearly be seen in FIG. 2, the left side wall 24 has a central fold edge 44 interposed between the upper end of permanent side seams 34, 36. Likewise the right side wall 26 has a central fold edge 46 interposed between the upper end of permanent side seams 38, 40.

Figure 5:
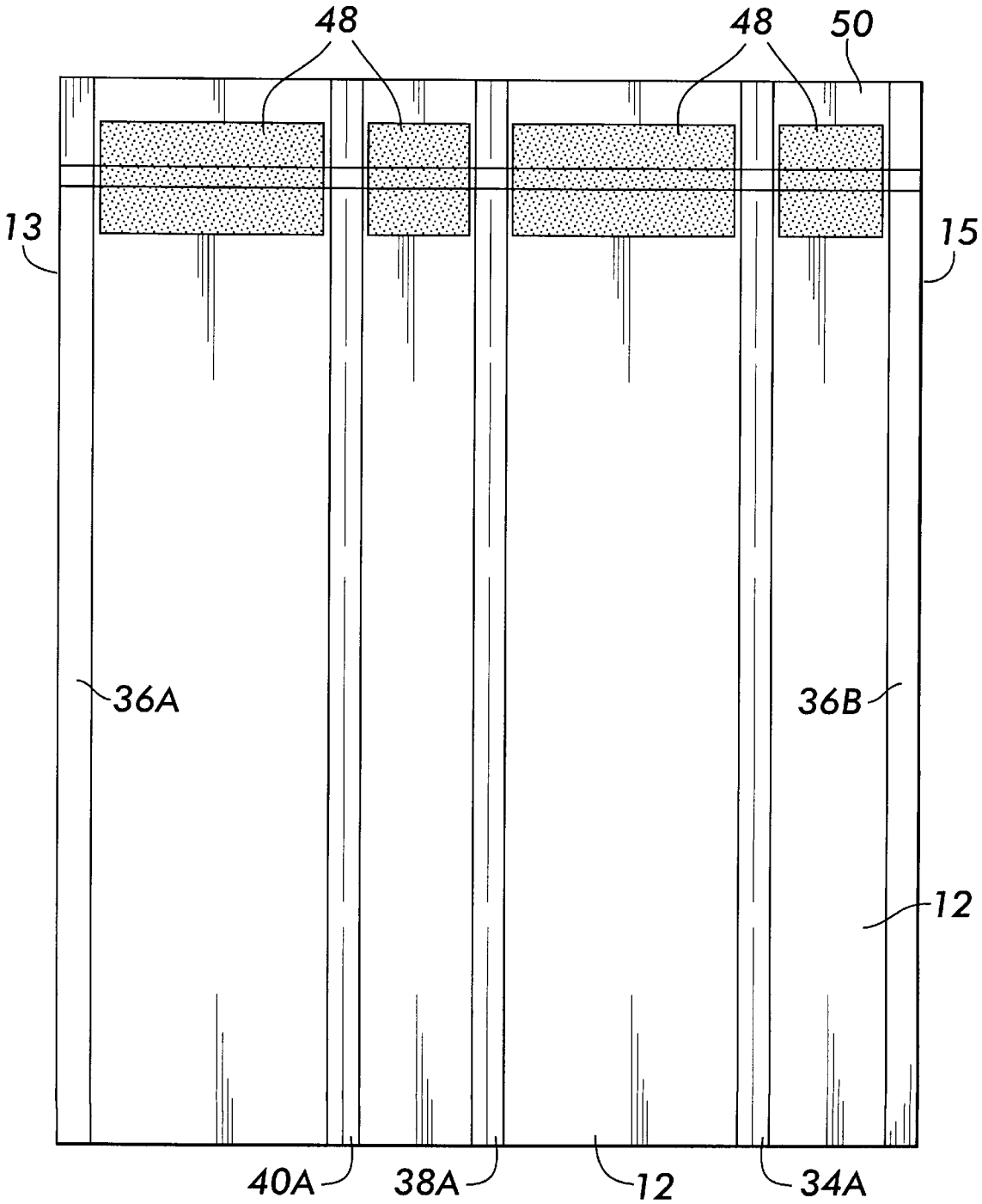
FIG. 5 is a front view of a sheet of laminated material having areas of peel seal material as used in the package of FIG. 1.

The means constructing the package 10 and for sealing the upper end 14 of the package 10 will now be described. As indicated above, and as can be seen in FIG. 5, the package 10 is fabricated from a long strip of any suitable flexible sheet material 12, which preferably is formed from a flat sheet. The package is formed form one sheet of laminated material 12 having strategically placed areas of peel seal material 48 applied to the side of the material to be sealed. A preferable form of the laminated material is a composite as follows.

0.00048 inch Polyester Film
0.00015 inch Printing Ink
0.00010 inch Laminating Adhesive
0.00028 inch Aluminum Foil
0.00010 inch Laminating Adhesive
0.00048 inch Polyester Film
0.00010 inch Laminating Adhesive
0.00300 inch Polyethylene Film 0.00015 inch Peel Seal Coating (applied in pattern)

However, any suitable material known in the art in combination with the peel seal coating may be appropriate. The peel seal coating may be secured to the inner surface of a side wall of the package by any method known in the art, for example, by heat sealing.

Figure 6:
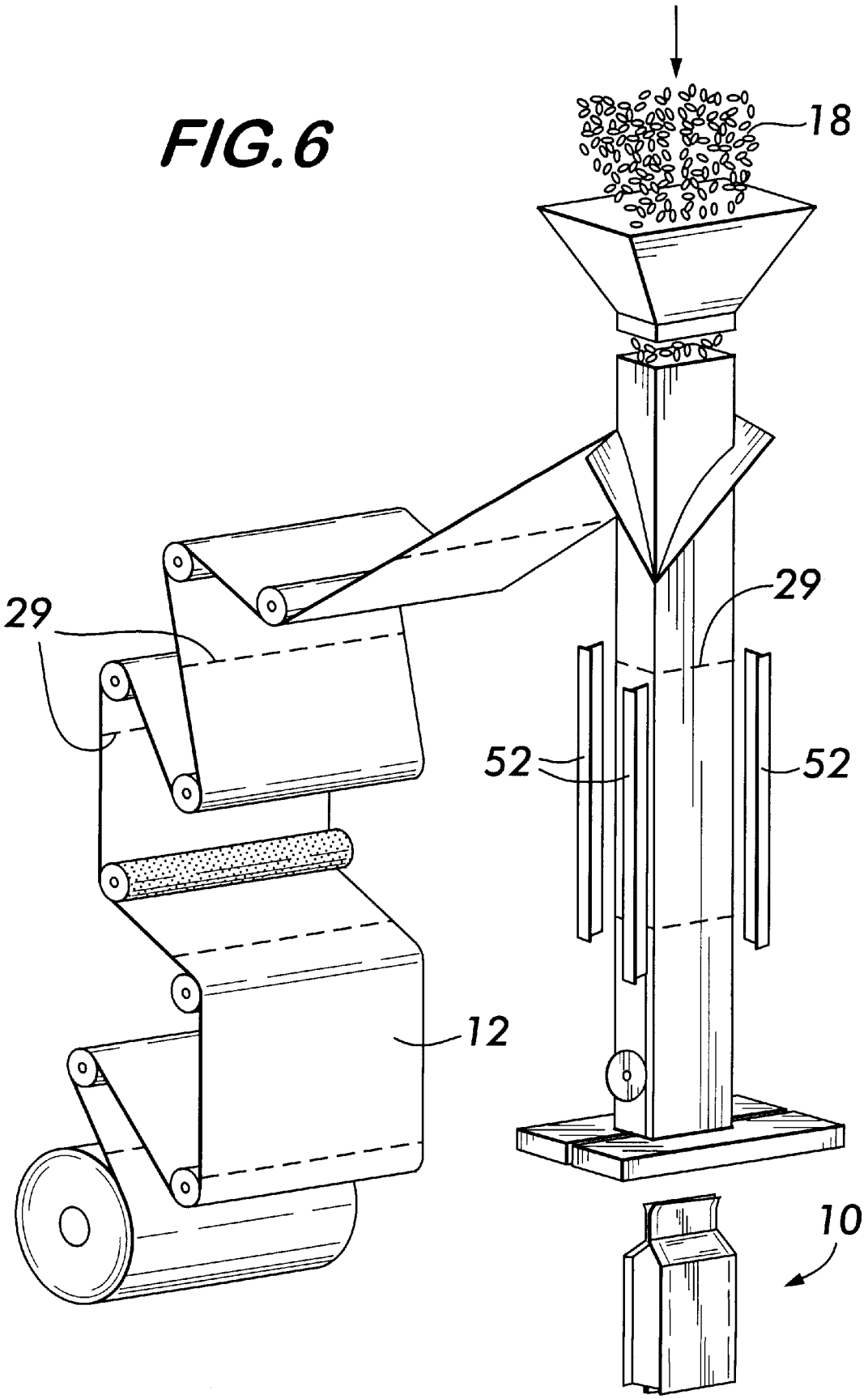
FIG. 6 is a perspective view, greatly simplified, of a system for forming the package shown in FIG. 1.

As can be seen in FIG. 5, the flexible sheet material 12 is cut into a rectangular shape. The parallel edges 13, 15 of the rectangular flexible sheet material 12 that are roughly perpendicular to the line of peel seal material are brought together and sealed to form a tube (not shown) at permanent seal line 36 (see FIG. 1) by edges 36A and 36B of the flexible sheet material 12. Permanent seal line 36 is preferably about 5 millimeters wide. Note that the peel seal material 48 does not extend into this permanent seal area made from edges 36A and 36B. As can be seen in FIG. 6, the tube is formed into parallelepiped shape with the permanent seal lines 34, 36, 38, 40 forming the four 90° angles of flexible sheet material 12. Permanent seal lines 34, 38 and 40 include folded material sealed with preferably five millimeters wide seal lines over the length of the parallelepiped by edge seal bars 52 . Note that the peel seal material 48 again does not extend from the open areas which do not form the seams into the three permanent seal areas 34A, 38A and 40A.

The permanent seal line along the bottom edge 42 (opposite the peel seal edge) is used to form the bottom seal. Opposing side walls 24, 26 of the parallelepiped are tucked at the bottom edge and the seal 42 is placed along the bottom section 28 of the package 10. The package is now roughly in the shape of an open box. Now, for example, sixteen ounces of coffee beans or other product 18 are placed into the package 10 through the open top (see FIG. 5). Opposing side walls, left side wall 24 and right side wall 26 of the parallelepiped-shaped package 10 are tucked at the top edge and a the package 10 is sealed parallel to the top edge of the upper end 14 of the package 10 by the peel seal material 48.

The flexible package with sealed edges 10 and easy to open mouth is best described through disclosure of the above preferred embodiment. This description is not meant to limit the size, shape or product type of the subject invention. The package may be formed of a variety of paper, plastic, and/or foil materials as required by the nature of the product to be packaged and its distribution.

By applying the peal seal material 48 only to the area of the package 10 requiring opening, and specifically stopping the peel seal material 48 prior to its extending into the permanent seal lines 34, 36, 38, 40, those seal lines remain permanently sealed to give the package the desired squared off appearance. Furthermore, one of the four seal lines (34 in the present embodiment) joins the edges of the sheet material 12. If this seal were peelable, the bag formed from the sheet material 12 would separate at this seam, thus spilling the contents of the package.

Figure 2:
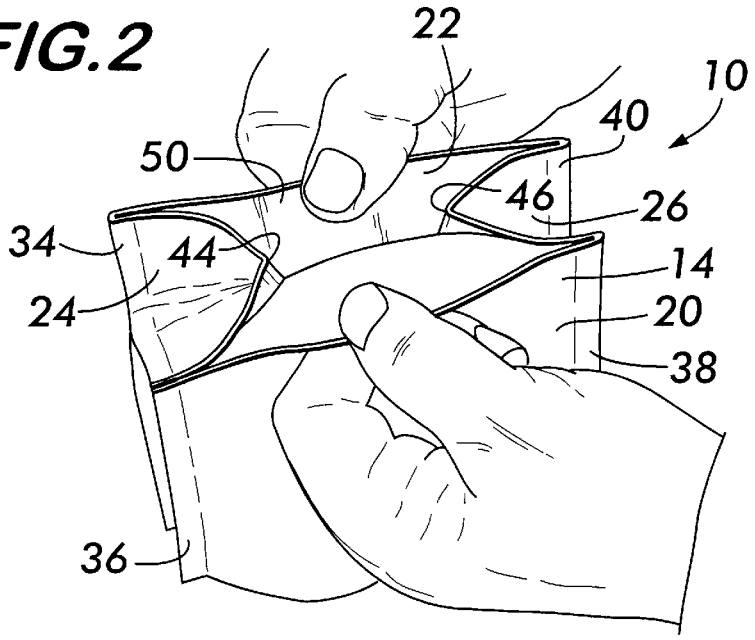
FIG. 2 is a perspective view of a portion of the package of FIG. 1 depicted as the package is being opened.
Figure 3:
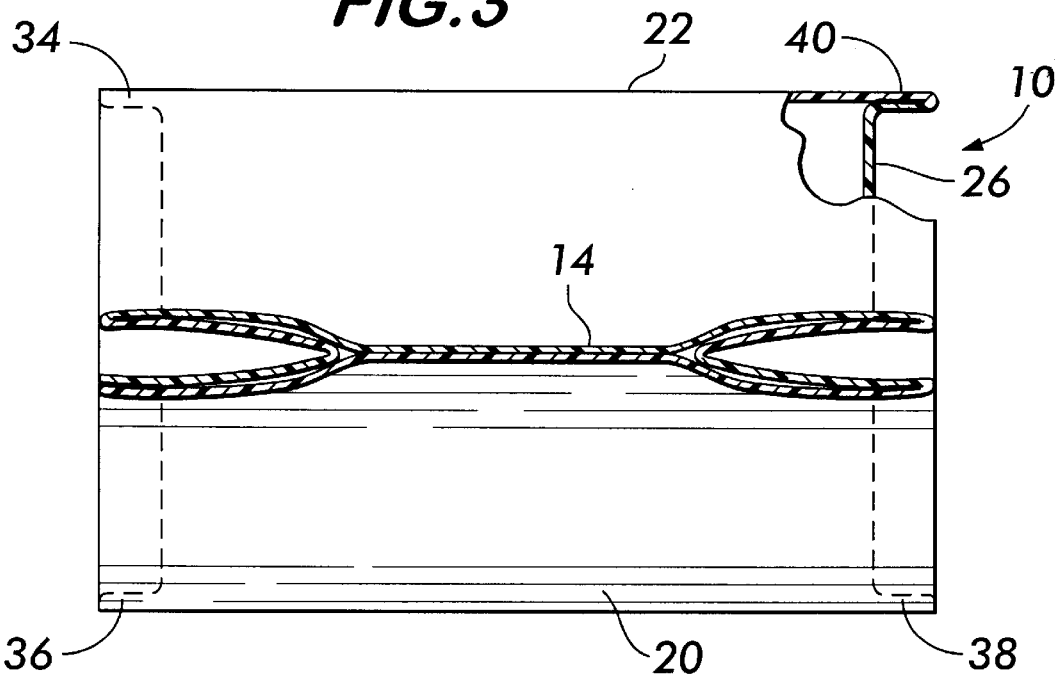
FIG. 3 is a top, cutaway view of the package of FIG. 1, taken substantially along line 3—3 of FIG. 1.
Figure 4:
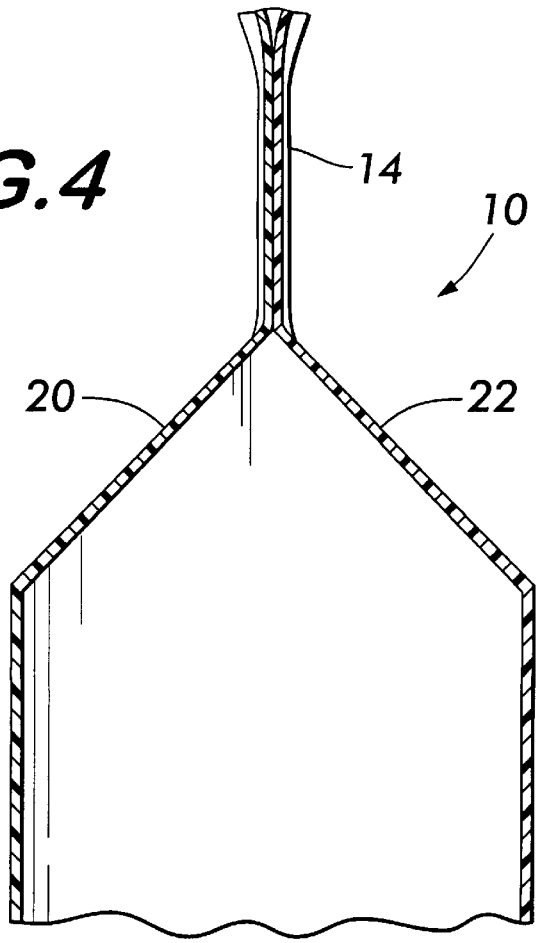
FIG. 4 is a partial, side cutaway view of the package of FIG. 1, taken substantially along line 4—4 of FIG. 1.

As can be seen in FIG. 2, the package 10 may be opened through hand manipulation of the area above the peel seal material 48 at the upper end 14 of the package 10. Note that the peal seal material preferably does not fully extend to the upper edge of the package, but that an unsecured edge 50 parallel to the top of the bag allows access by the hands of a user. The center of the front panel 20 along the top edge is grasped in one hand. The center of the back panel 22 along the top edge is grasped in the other hand. Hands are moved apart causing force to be applied to the top seal (made through the peel seal material) thus causing the top seal to open. The bag contents are now readily accessed.

The package may have tin-tie reclosure (not shown), a "snap style" reclosure 27, or other reclosure such as a zipper (not shown). The package may have a one way degassing valve to allow fresh roasted coffee to gas off into the seal bag and release excess pressure without rupturing the bag.

It must be pointed out that at this time that the single package 10 shown in the drawings may be manufactured (fabricated) as one of a large number of serially connected, identical packages. The serially connected packages may be rolled up and stored in a roll (not shown) until they are separated for filling. Thus, the lower end 16 of any one package 10 except the last, of the roll of plural packages may be secured to the upper end 14 of the next succeeding package 10 of the roll by a separation line, e.g., a perforated line 29. The separation lines are created during the package fabrication process in a conventional manner and thus will not be discussed in detail herein. Suffice it to state that when the packages are separated, the separation lines form the upper and lower marginal ends of the package.

Without further elaboration, the foregoing will so fully illustrate our invention that others may, by applying current or future knowledge, readily adopt the same for use under various conditions of service.

I claim:

1. A package having a longitudinal axis comprising a flexible sheet material capable of being sealed for closing off the interior of the package from the ambient atmosphere, said package having four side walls and a bottom formed by said sheet material, said four side walls having an open upper end portion terminating in a free edge, each of said walls including an inner surface and an outer surface, and a permanent seal area and an open area on said inner surface, said four side walls including a first side wall, a second side wall adjacent and sealed to said first side wall along a first permanent seal, a third side wall adjacent to and sealed to said second side wall by a second permanent seal and opposed to said first side wall, and a fourth side wall opposed to said second side wall and adjacent to and sealed to said first side wall by a third permanent seal and said third side wall by a fourth permanent seal, said inner surface of said four side walls having a releasably securable adhesive in a pattern adjacent said upper end portion on said open areas of said walls extending to, but not coinciding with said permanent seal areas, said permanent seal areas being permanently sealed with substantially no releasably securable adhesive thereon, said package being in a sealed condition by means of said releasably securable adhesive when said upper end portion of said first wall is secured to said upper end portion of said second wall and said upper end portion of said upper end portion of said fourth wall, said upper end portion of said third wall is secured to said upper end portion of said second wall and said upper end portion of said fourth wall, and a portion of said upper end portion of said second wall is secured to a portion of said upper end portion of said third wall.

2. The package of claim 1, further comprising a degassing valve integral to a side wall to release excess pressure in the package so the package does not rupture.

3. The package of claim 1, wherein an area adjacent the open end portion of the package is free of the releasably securable adhesive to provide a gripping zone to enable a user to easily open the package.

4. The package of claim 1, wherein the releasably securable adhesive is 0.00015 inches thick.

5. The package of claim 1, wherein the package further includes a reclosure adjacent the open end portion of the package.

6. The package of claim 5, wherein the reclosure is of a snap style.

7. The package of claim 1, wherein the package is formed from a single sheet, separated from other package sheets by a perforated line.

8. The package of claim 1, wherein the releasably securable adhesive is heat sealed onto the inner surface of said side walls.

9. The package of claim 1, wherein the package is formed primarily from a plastic material.

10. A package comprising a flexible sheet material capable of being sealed for closing off the interior of the package from the ambient atmosphere, said package having four side walls and a bottom formed by said sheet material, said four side walls having an open upper end portion terminating in a free edge, each of said walls including an inner surface and an outer surface, a permanent seal area and an open area at said upper end portion, said four side walls including a first side wall, a second side wall adjacent to and sealed to said first side wall along a first permanent seal line, a third side wall adjacent to and sealed to said second side wall by a second permanent seal, and opposed to said first side wall, and a fourth side wall opposed to said second side wall and adjacent to and sealed to said first side wall by a third permanent seal and said third side wall by a fourth permanent seal, said inner surface of said four side walls having a releasably securable adhesive adjacent said upper end portion on said open areas of said walls extending to, but not touching said permanent seal areas, said permanent seal areas being permanently sealed with substantially no releasably sealable adhesive thereon, said package being in a sealed condition by means of said releasably securable adhesive when said upper end portion of first wall and said upper end portion of said third wall are in a folded position, each forming a first half and a second half, wherein said first half of each of said upper end portion of said first wall and said upper end portion of said third wall is secured to said upper end portion of said second wall and said second half of each of said upper end portion of said first wall and said upper end portion of said third wall is secured to said upper end portion of said fourth wall, and a portion of said upper end portion of said second wall is secured to a portion of said upper end portion of said third wall, whereby the upper end portion of the package that terminates in a free edge substantially seals the package.

11. The package of claim 10, further comprising a degassing valve integral to a side wall to release excess pressure in the package so the package does not rupture.

12. The package of claim 10, wherein an area adjacent the open end portion of the package is free of the releasably securable adhesive to provide a gripping zone to enable a user to easily open the package.

13. The package of claim 10, wherein the releasably securable adhesive is 0.00015 inches thick.

14. The package of claim 10, wherein the package further includes a reclosure adjacent the open end portion of the package.

15. The package of claim 14, wherein the reclosure is of a snap style.

16. The package of claim 10, wherein the package is formed from a single sheet, separated from other package sheets by a perforated line.

17. The package of claim 10, wherein the releasably securable adhesive is heat sealed onto the inner surface of said side walls.

18. The package of claim 10, wherein the package is formed primarily from a plastic material.

* * * * *